US011406553B2

(12) United States Patent
Chong

(10) Patent No.: US 11,406,553 B2
(45) Date of Patent: Aug. 9, 2022

(54) ADJUSTABLE STRETCH BAR SYSTEM FOR INVERSION TABLE

(71) Applicant: On Chong, Sunnyvale, CA (US)

(72) Inventor: On Chong, Sunnyvale, CA (US)

( * ) Notice: Subject to any disclaimer, the term of this patent is extended or adjusted under 35 U.S.C. 154(b) by 419 days.

(21) Appl. No.: 16/720,977

(22) Filed: Dec. 19, 2019

(65) Prior Publication Data

US 2021/0069049 A1 Mar. 11, 2021

Related U.S. Application Data

(60) Provisional application No. 62/898,332, filed on Sep. 10, 2019.

(51) Int. Cl.
*A61H 1/02* (2006.01)

(52) U.S. Cl.
CPC ... *A61H 1/0229* (2013.01); *A61H 2201/0192* (2013.01); *A61H 2201/1635* (2013.01); *A61H 2203/0493* (2013.01)

(58) Field of Classification Search
CPC ..... A61H 1/0229; A61H 2201/0192; A61H 2201/1635; A61H 2203/0493; A61H 2201/1253; A61H 2205/081; A61H 1/0292; A61H 2201/1284; A61H 2201/1623; A61H 2201/1642; A61H 1/00
See application file for complete search history.

(56) References Cited

U.S. PATENT DOCUMENTS 5,637,079 A * 6/1997 Miller ..... A61H 1/0218 606/241
6,213,923 B1 * 4/2001 Cameron ..... A63B 21/012 297/50
7,118,518 B1 * 10/2006 Teeter ..... A61H 1/0218 482/145
8,062,198 B2 * 11/2011 Wei ..... A61H 1/0218 482/145
8,342,978 B2 * 1/2013 Tamura ..... A63B 24/0021 473/226
8,556,787 B2 * 10/2013 Leier ..... A61H 1/0222 482/144
8,764,617 B2 * 7/2014 Teeter ..... A61H 1/0292 482/126
9,849,056 B2 * 12/2017 Chen ..... A63B 21/00069
10,035,039 B1 * 7/2018 Jui ..... A63B 21/00047
2009/0054216 A1 * 2/2009 Teeter ..... A61N 5/06 482/144
2009/0054217 A1 * 2/2009 Teeter ..... A61H 1/0218 482/144
2013/0029812 A1 * 1/2013 Teeter ..... A61H 1/0292 482/126
2013/0079204 A1 * 3/2013 Wang ..... A61H 1/0222 482/144

(Continued)

*Primary Examiner* — Garrett K Atkinson
(74) *Attorney, Agent, or Firm* — The Drew Kim Law Firm PLLC

(57) ABSTRACT

A stretch bar for an inversion therapy table. The stretch bar has two support bars that are connected at one end by a connecting beam and has handles at the other ends of the support bars. The handles are located above the user and enable the user to pull or push on the handles to increase or decrease the amount of inversion therapy. The support bars may be adjustable in length, such as by using a pin and hole adjustment configuration. The support bars may be connected by a second connecting beam.

6 Claims, 6 Drawing Sheets

(56) References Cited

U.S. PATENT DOCUMENTS

| | | | | |
|---|---|---|---|---|
| 2013/0079205 | A1* | 3/2013 | Leier | A61H 1/0222<br>482/144 |
| 2015/0305962 | A1* | 10/2015 | Noel | A61H 1/0229<br>602/36 |
| 2016/0228320 | A1* | 8/2016 | Mabry | A61F 5/042 |
| 2016/0324712 | A1* | 11/2016 | Carlin | A61H 1/0229 |
| 2017/0128309 | A1* | 5/2017 | Chen | A47C 7/5066 |
| 2018/0271736 | A1* | 9/2018 | Leier | A61H 1/0292 |

* cited by examiner

ADJUSTABLE STRETCH BAR SYSTEM FOR INVERSION TABLE

This application claims priority to U.S. provisional patent application Ser. No. 62/898,332, filed Sep. 10, 2019 and is hereby incorporated by reference herein.

BACKGROUND

Field of the Invention

Generally, the present invention relates to an adjustable stretch bar system for an inversion therapy table that allows a user to pull or push by pulling or pushing on handles on the stretch bar.

Description of Related Art

Inversion tables are known for stretching the lower back and for providing temporary back pain relief More generally, inversion therapy involves lying flat on your back at an angle or hanging upside down, in head-down position. Current inversion therapy tables rely on the user being inverted in order to provide inversion therapy. The user's ankles and lower legs are held in place by the table. While inverted, gravity on the user provides stretching to the user's body and thereby inversion therapy.

Current inversion therapy tables rely on the degree of inversion to apply the degree of inversion therapy. The greater the degree of the table's inversion, the greater the degree of stretching is applied to the user, and vice versa.

Current inversion therapy tables do not have a mechanism to allow the user to apply more inversion therapy, or stretching, in addition to or in place of increasing the degree of the table's inversion. Some users cannot or do not want to invert to a greater degree in order to achieve the desired level of inversion therapy. For example, some users may not or cannot adapt to a very steep inversion slope, which may prevent them from obtaining the full benefits of inversion.

Current inversion therapy tables also do not have a mechanism to allow a user to apply less inversion therapy, other than decreasing the inversion angle of the table. Some users may wish to maintain the inversion angle of the table but decrease the amount of inversion therapy applied.

The present disclosures address at least some of the issues described above.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

The embodiments herein provide for a system and apparatus wherein an inversion table includes an adjustable stretch bar. The stretch bar includes handles that the user may grasp with their hands. While on the inversion table, the user may pull on the handles to apply more stretching, or inversion therapy, or push against the handles to decrease the amount of inversion therapy. This allows the users to adjust the level of inversion therapy without adjusting the inversion angle of the table. This also can make use of the inversion table a more comfortable experience.

One embodiment utilizes adjustable bars to adjust the distance of the handles from the user to account for varying sizes of users.

One embodiment utilizes a retraining bar to limit the amount of the inversion angle and prevent the stretch bar from hitting the floor while inverting.

BRIEF DESCRIPTION OF THE FIGURES

The disclosed subject matter will hereafter be described with reference to the accompanying drawings, wherein like reference numerals denote like elements; and.

Figure 1:
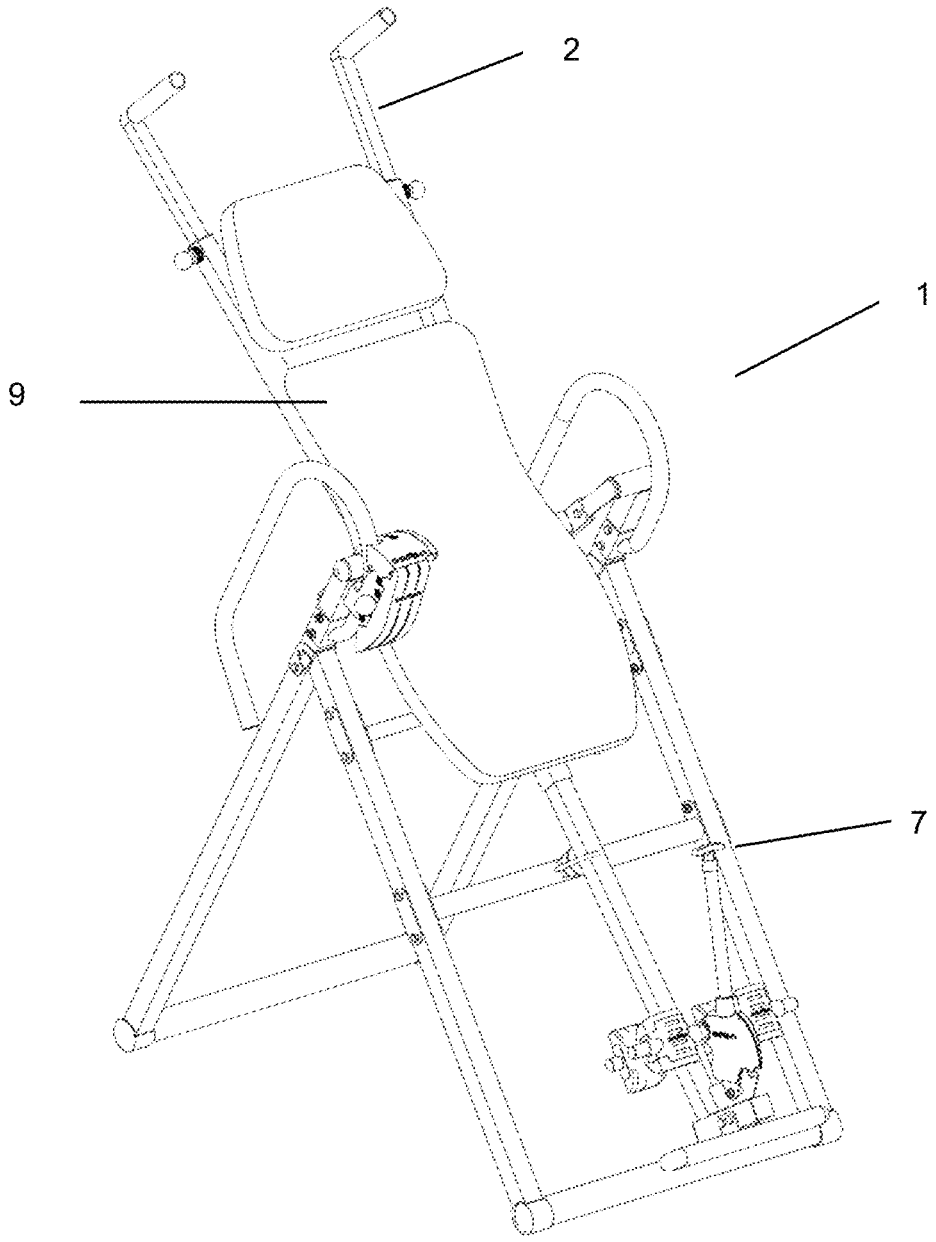
FIG. 1 provides a perspective view of an inversion table with a stretch bar in accordance with some embodiments of the present invention.

While the disclosed subject matter is susceptible to various modifications and alternative forms, specific embodiments thereof have been shown by way of example in the drawings and are herein described in detail. It should be understood, however, that the description herein of specific embodiments is not intended to limit the disclosed subject matter to the particular forms disclosed, but on the contrary, the intention is to cover all modifications, equivalents, and alternatives falling within the spirit and scope of the disclosed subject matter as defined by the appended claims.

DETAILED DESCRIPTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 2:
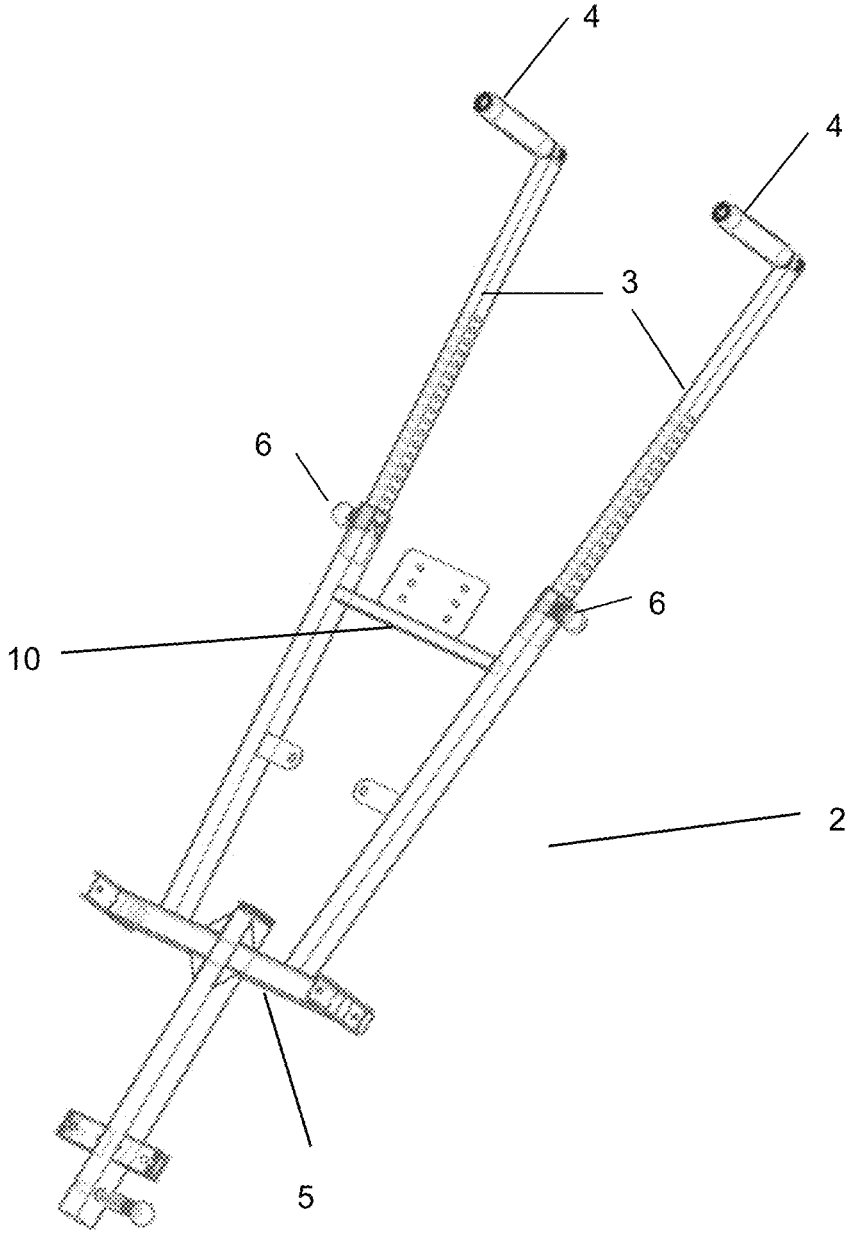
FIG. 2 provides a perspective view of the stretch bar.
Figure 3:
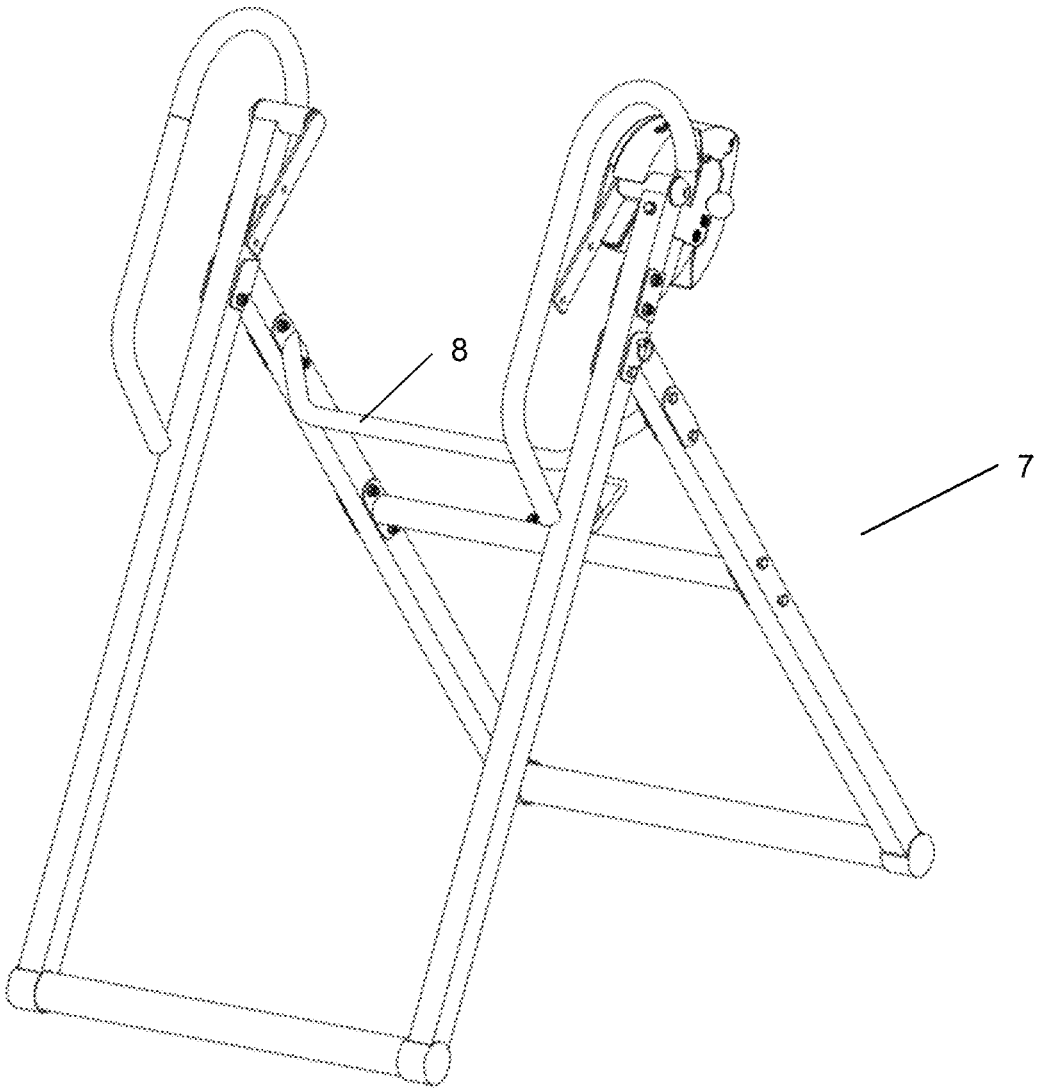
FIG. 3 provides a perspective view of a support frame of the inversion table.

With reference to FIGS. 1 to 3, a stretch bar (2) for an inversion therapy table (1) having a support frame (7) and backrest (9). The backrest (9) is attached to the stretch bar (2), which in turn is rotatably connected to the support frame (7).

Figure 4A:
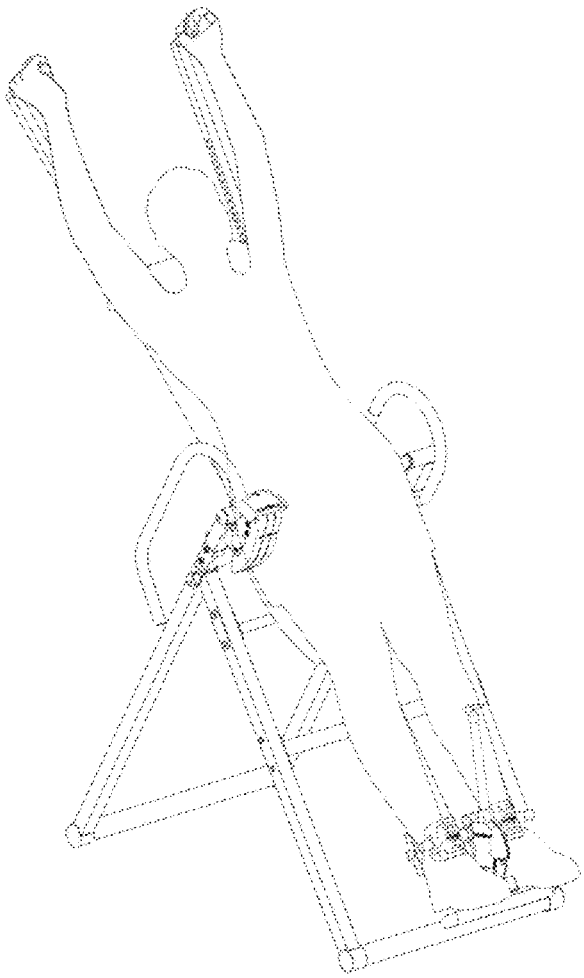
FIG. 4A provides a perspective view of the inversion table with a taller user.
Figure 4B:
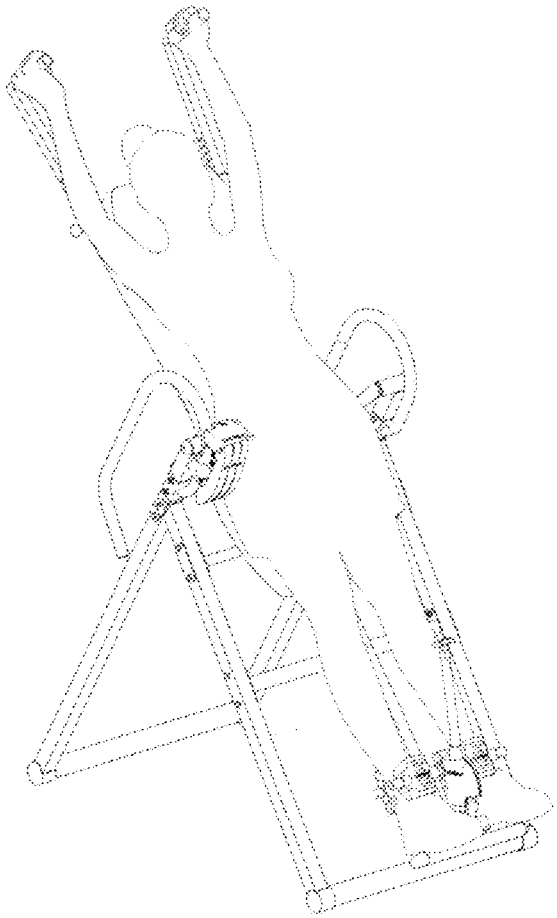
FIG. 4B provides a perspective view of the inversion table with a shorter user.

The stretch bar (2) has two support bars (3), each having a handle (4) at the end. The support bars (3) and handles (4) are configured such that the handles (4) are located farther from a user's feet than the user's head while on the inversion table. This places the handles (4) above the user's head, as shown in FIGS. 4A and 4B.

The handles (4) may be of varying shapes and sizes to provide comfort to the user's hands. The handles (4) may be attached at varying angles relative to the longitudinal axis of the support bars (3), including at a perpendicular angle.

The support bars (3) may be adjustable in length by a multiple hole and adjustment pin (6) configuration, where each support bar is made of two sections that fit together. The length of the support bars (3) may be adjusted via other means determined by one of ordinary skill in the art.

The support bars (3) are connected at one end by a connecting beam (5). The connecting beam (5) provides additional structure and support for the inversion table (2). A second connecting beam (10) may be attached to the support bars (3) along their length to provide additional structure and support.

The support frame (7) may include a restraining bar (8) configured such that it will stop the angle of inversion of the stretch bar (2). The stretch bar (2) will contact the restraining bar (8) once a maximum amount of inversion angle is reached, thereby limiting the angle that the user is inverted.

FIGS. 4A and 4B illustrate a taller user and a shorter user, respectively, on the inversion table prior to inversion. Although not inverted, the users can apply some degree of inversion therapy by pulling on the handles (4), thereby decreasing the effect of gravity on the users' bodies.

The supports bars (3) in FIG. 4A are adjusted to a longer length than the support bars (3) in FIG. 4B to accommodate the taller user shown in FIG. 4A.

Figure 5A:
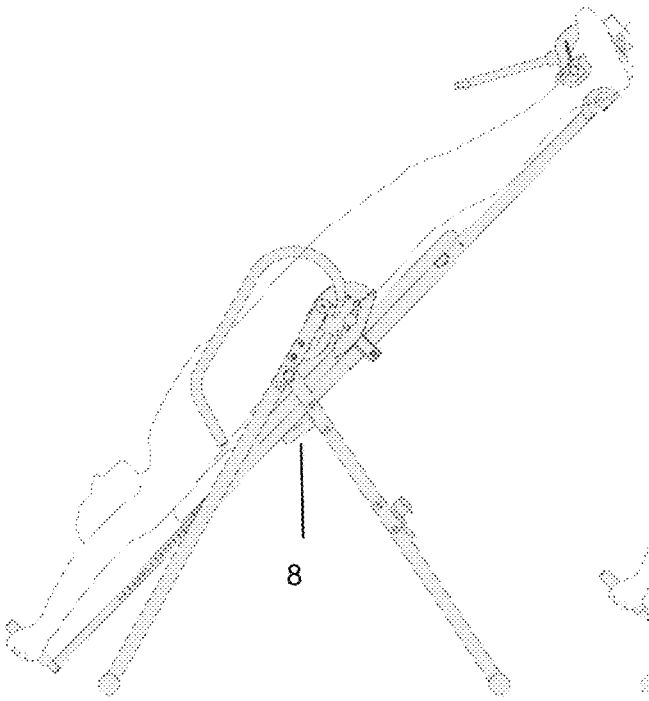
FIG. 5A provides a perspective view of the inversion table with the taller user during inversion therapy.
Figure 5B:
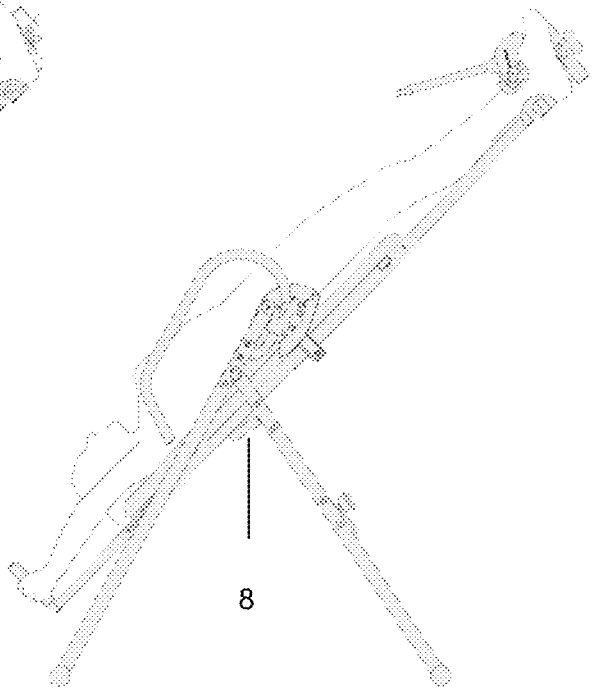
FIG. 5B provides a perspective view of the inversion table with the shorter user during inversion therapy.

FIGS. 5A and 5B illustrate the taller user and shorter user after the being inverted. The users' hands are shown grabbing the handles (4). With hands on the handles (4), the users can now push on the handles (4) to lessen the degree of stretching, or inversion therapy, on their bodies. Conversely, the users can pull on the handles (4) to increase the degree of stretching, or inversion therapy, on their bodies.

FIGS. 5A and 5B also illustrate the angle of inversion being limited by the restraining bar (8). The stretch bars (2) have contacted the restraining bar (8), thus stopping the stretch bars (2) from rotating any farther relative to the support frame (7).

Figure 6:
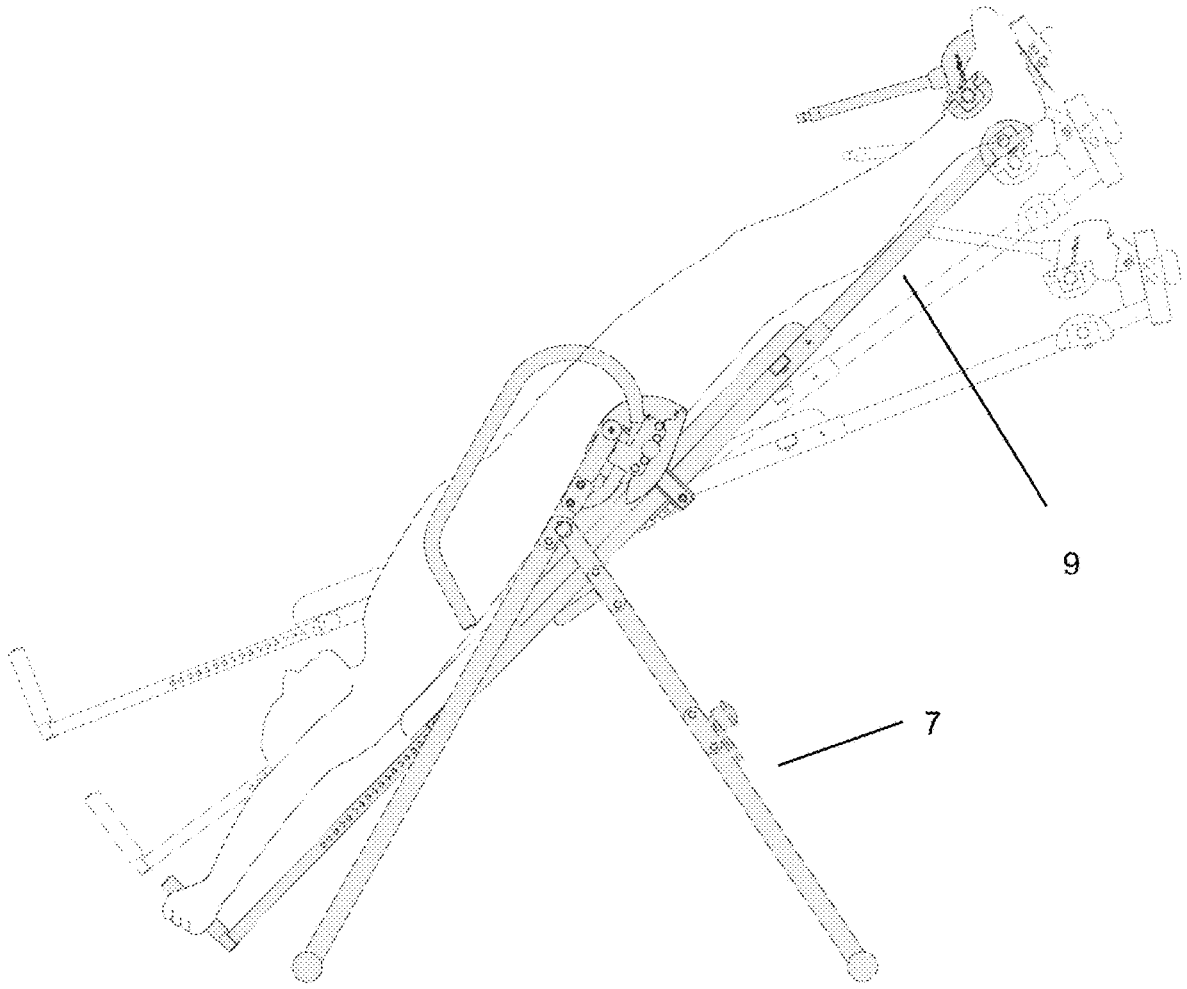
FIG. 6 provides a perspective view of the inversion table with a user at various angles of inversion.

FIG. 6 illustrates that the inversion table (1) can be set at various angle of inversion. Using the handles (4) on the stretch bars (2), the user can apply various strengths of inversion therapy by the degree that the user is inverted and the amount that the user pulls or pushes on the handles (4). For example, the user may not be able to tolerate having their body inverted to a great degree. That user could invert the table to a lesser, comfortable degree yet still achieve the desired strength of inversion therapy by pulling on the handles (4) with their hands. In another example, the user may be inverted on the table and wish to temporarily increase or decrease the degree of inversion therapy. That user can achieve this by grabbing the handles (4) with their hands and push or pull on the handles (4) to adjust the degree of inversion therapy.

The particular embodiments disclosed above are illustrative only, as the disclosed subject matter may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the disclosed subject matter. Accordingly, the protection sought herein is as set forth in the claims below.

What is claimed is:

1. An inversion therapy table comprising
a support frame,
a user inversion frame rotatably connected to the support frame,
the user inversion frame comprising
a backrest having a front side, a back side, a top edge, and a bottom edge, with the bottom edge being located proximate a foot support on the user inversion frame,
a stretch bar connected to the back side of the backrest,
the stretch bar comprising
a first support bar having a first end and a second end,
a first handle connected to the first end of the first support bar,
a second support bar having a first end and a second end,
a second handle connected to the first end of the second support bar,
a connecting beam having a first end and a second end, wherein the second end of the first support bar is connected proximate to the first end of the connecting beam and the second end of the second support bar is connected proximate to the second end of the connecting beam such that
the first support bar and second support bar are approximately parallel,
the first support bar having a length that places the first handle above the top edge of the backrest, and
the second support bar having a length that places the second handle above the top edge of the backrest.

2. The inversion therapy table of claim 1, wherein
the first support bar and the second support bar include a length adjustment mechanism.

3. The inversion therapy table of claim 1, wherein
the first support bar is comprised of a first and second tube, wherein the outer diameter of the first tube is smaller than the inner diameter of the second tube, the first tube includes at least two adjustment holes along its length, and the second tube includes an adjustment pin configured to fit within an adjustment hole.

4. The inversion therapy table of claim 1, further comprising
a second connecting beam having a first end and a second end, wherein the first end of the second connecting beam is connected to the first support bar between the first and second end of the first support bar and the second end of the second connecting beam is connected to the second support bar between the first and second end of the second support bar.

5. The inversion therapy table of claim 1, wherein
the first handle is approximately perpendicular to the first support bar, and
the second handle is approximately perpendicular to the second support bar.

6. The inversion therapy table of claim 1, wherein
the support frame comprises a restraining bar.

* * * * *